US005114030A

United States Patent [19]

Conard

[11] Patent Number: 5,114,030

[45] Date of Patent: May 19, 1992

[54] TIP OFF CONTAINER CAP WITH REMOVABLE STEM

[75] Inventor: William A. Conard, Harleysville, Pa.

[73] Assignee: The West Company, Incorporated, Phoenixville, Pa.

[21] Appl. No.: 574,744

[22] Filed: Aug. 30, 1990

[51] Int. Cl.[5] ..... B65D 41/62

[52] U.S. Cl. ..... 215/249; 215/251; 215/DIG. 3; 220/269

[58] Field of Search ..... 215/249, 251, 32, DIG. 3; 220/269

[56] References Cited

U.S. PATENT DOCUMENTS

| | | | |
|---|---|---|---|
| 3,358,865 | 12/1967 | Andersen | 215/249 |
| 3,379,326 | 4/1968 | Andersen | 215/249 |
| 4,089,432 | 5/1978 | Crankshaw et al. | 215/DIG. 3 X |
| 4,111,324 | 9/1978 | Winchell | 215/232 |
| 4,171,236 | 10/1979 | Winchell et al. | 215/251 X |
| 4,194,640 | 3/1980 | Crankshaw et al. | 215/249 X |
| 4,274,543 | 6/1981 | Braymer, Jr. et al. | 215/249 X |
| 4,821,897 | 4/1989 | Weiler | 215/32 |
| 4,863,049 | 9/1989 | Suzuki et al. | 215/249 |
| 4,869,384 | 9/1989 | Ogle, II | 215/247 |

FOREIGN PATENT DOCUMENTS 0199969 4/1989 Japan .

*Primary Examiner*—Marcus, Stephen
*Assistant Examiner*—Stephen Cronin
*Attorney, Agent, or Firm*—Eugene E. Renz, Jr.

[57] ABSTRACT

A container cap, comprising a cap body having an annular shoulder with an inner and outer terminal edge. The shoulder has a skirt depending from the outer terminal edge of the shoulder and an upper cylinder is attached to the annular shoulder at its inner terminal edge. The cylinder extends upward, terminating in an annular flared lip and the upper cylinder is attached to the shoulder by an annular scoring ring.

3 Claims, 3 Drawing Sheets 30
11
13
23
15
13
29
25

9
25
11
12
9
13
15
16

25
15
12
19
17
13

19
11
12
27
15
13
21

10
19
17
13
8
8
11
15
16
12

TIP OFF CONTAINER CAP WITH REMOVABLE STEM

FIELD OF THE INVENTION

The present invention relates to an improved closure devise for use with containers, particularly those having rubber stoppers, such as those containers used in the pharmaceutical industry. More particularly, the invention relates to a cap means which can be easily removed by the pressure from one's thumb.

BACKGROUND OF THE INVENTION

Closure assemblies have been employed with containers generally and have found particular use in the pharmaceutical industry. Pharmaceutical containers for liquids or for solids which are reconstituted by the addition of liquids have a piercable closure member such as a disc or stopper formed of rubber or other elastomers. They are also provided with a metallic cap, usually aluminum, to hold the stopper in place.

In many designs, particularly in the pharmaceutical industry, the stopper is covered by a protective device such as a cap until access to the contents of the container is needed. In one design, a central removable disc is detachably secured to the outer portion of the cap through the use of fracturable bridges. By lifting off this center disc portion, the stopper area is exposed and access to the contents is provided.

Another alternative technique is the use of a tear off cap which provides a hinged central portion at the top of the cap, to provide a grip for tearing off the cover over the stopper and around the top of the container. These systems include a cap portion and a pull tab section with lines or scores for guiding the direction of tear. The difficulty with these designs is that either the tear portion or the closure has a sharp edge which can inadvertently injure the user.

In some instances, it is desirable to remove the stopper, rather than expose it for puncture by a syringe. U.S. Pat. No. 4,384,653 discloses a tip-off cap and closure in which an upper tubular elongated portion provides the leverage for tipping or pushing the lower or skirt portion off of the container and simultaneously removing the rubber stopper. This type of system is effective when the stopper is to be removed, but is, of course, not useful when the only suitable access will be the use of a syringe.

It has become clear that the assembly of pharmaceutical products and container in the most economical manner possible allows the supplier to pass on economies and efficiencies to the ultimate user of the product. More importantly, when a design is provided which is free from problems during hoppering, sealing and other assembly steps, manufacturing efficiencies allow the manufacture to be much more competitive in supplying what is now becoming a major article of commerce.

What would be greatly desirable would be a way to remove a portion of the cap to expose the stopper, while not involving complicated assembly procedures. Even though the pharmaceutical industry is intensely concerned about the integrity of the product produced, including the closure components, it is also driven by the need for greater efficiency and speed. For example, if a process which is otherwise quite reliable can be operated at a significant faster average operating speed, the unit cost is reduced without any adverse effect on product quality and integrity.

Accordingly, there appear to be two conflicting goals in efforts made to improve the application of closures to containers, particularly those for high speed assembly in the pharmaceutical industry. On the one hand, it is desirable to increase the strength and durability of the closure prior to assembly, to avoid downtime and a significant number of rejected products. On the other hand, the need for quick, easy and convenient opening of the container requires an easily removed overcap portion. This is particularly true because the user of the product has become dependent on a certain degree of ease, convenience and efficiency in opening containers.

Thus, it would be a great advance in the art if a new and improved design could be provided which would substantially simplify the manufacturing process while at the same time maintain or even improve the ease of use of the container by the final user.

These and other objects will become more apparent upon a reading of the description which follows.

SUMMARY OF THE INVENTION

It has now been discovered that the above and other objects of the present invention may be accomplished in the following manner. Specifically, the present invention comprises an improved closure device for use with a container, such as pharmaceutical containers having a thermoplastic elastomer stopper with an exposed outside surface portion or face. The closure device comprises a cap body having an annular shoulder and a dependent skirt which fits over the stoppered container and which may be crimped at the terminal edge of the skirt to insure that the cap body remains fastened to the container. Extending up from the annular shoulder is an upper cylinder which preferably has an upper terminal annular protrusion or flared lip. This upper cylinder is attached to the shoulder by an annular scored ring.

In one embodiment, the device includes a closure for a container having an opening, comprising a stopper in the opening, where the stopper has a first or outside surface. The capped member covers the stopper at the outside surface and has a portion which is in engagement or surface contact with the outside surface of the stopper. The engagement portion has a predetermined thickness. The cap member also includes a integral projection which extends away from the engaged portion of the closure. A thin plate portion extends from the engagement portion around the projection to join the projection to that engagement portion. The thin plate portion is, of course, of lesser thickness than the engagement portion in order to facilitate removal of the projection at the time that the projection is deflected by a predetermined amount. The cross section of the engagement portion of the cap declines toward the thin plate portion and the outside surface. The thin plate portion is also tapered and has a decreasing thickness in a direction from the engagement portion to the projection so that deflection and removal of the projection exposes a declined and tapered edge which extends toward the first outside surface on the rubber stopper. The declined end tapered edge remains in continuous contact against the stopper to inhibit that edge from functioning as a cutting edge.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
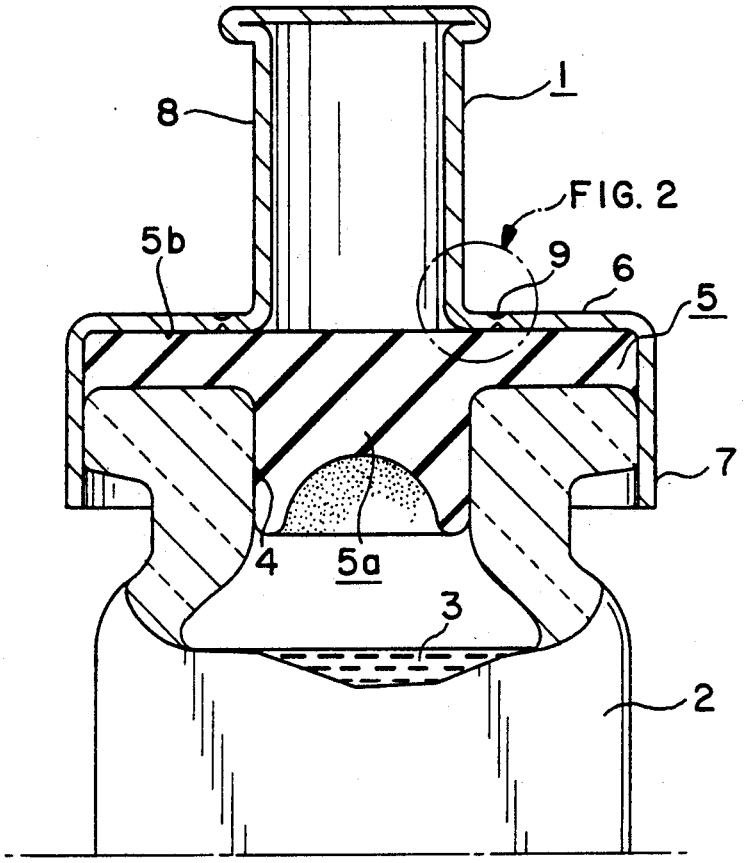
FIG. 1 is an elevational partially sectioned view of one embodiment of the present invention, showing the combination of a container having a stopper and the cap member of the present invention.

As shown in FIG. 1, a cap 1 generally is attached to a bottle 2 having contents 3 and an opening or neck 4. A stopper 5 is placed in the neck 4 such that the stopper 5 has a central area 5*a* for insertion of the needle into the interior of the bottle 2. Stopper 5 also has an exterior upward facing flange or surface 5*b* which faces away from the opening 4 of bottle 2.

The cap 1 is attached to the bottle 2 and stopper 5 with a cap body or annular shoulder portion 6 which has at its outer terminal edge a fixing or skirt 7. Extending up from the shoulder 6 is a cylindrical projection 8. The cap 1 is of unitary construction and includes a thin portion 9 in the form of an annular scoring groove or ring 9. As can be seen, pressure, such as by the thumb, on the cylindrical projection 8 will cause the thin portion or scoring 9 to fracture so that it can be removed and the inner portion 5*a* of the stopper 5 is now exposed for permitting access to the contents via a syringe.

Figure 2:
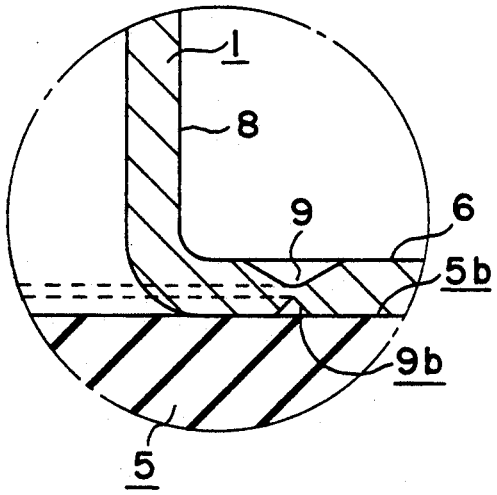
FIG. 2 is an enlarged sectional view of the portion within the dot and dash circle in FIG. 1 and identified FIG. 2.

As seen in FIG. 2, the shoulder or cap body 6 is in contact with the top surface 5*b* of stopper 5 and the thin portion or groove 9 decreases in cross section and declines and forms a tapered edge. This tapered edge 9*b* is declined and tapered toward the top surface 5*b* of stopper 5, such that the underside of the thin portion 9 is in continuous contact against the top 5*b* of stopper 5. When it is removed, the projection 8 no longer compresses surface 5*b*. At this time, rubber spring back or billowing takes place, so that edge 9*b* is enveloped by surface 5*b* of stopper 5.

Turning now to FIGS. 3 through 7, an assembly 10 includes a cap 11 and bottle 12. The cap 11 is attached to the bottle 12 through a shoulder or body portion 13 which has a dependent skirt 15 firmly attaching the cap 11 to the container. The skirt 15 may have its lower terminal edge 16 turned under or crimped in order to secure the attachment of the cap to the bottle.

Figures 3, 4, 5, 6, 7:
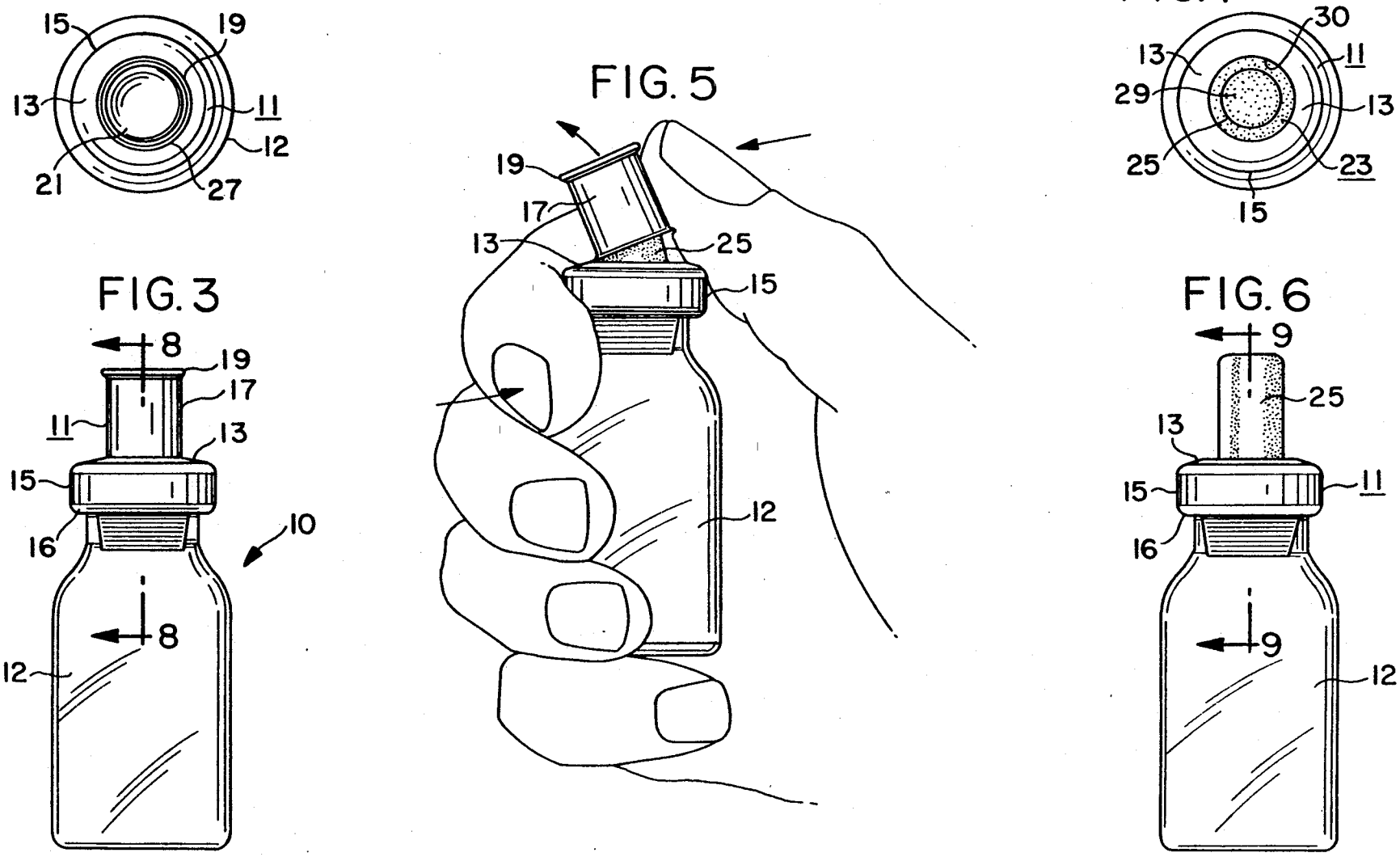
FIG. 3 is a side elevational view of a bottle, stopper and cap in accordance with another embodiment of the present invention.
FIG. 4 is a plan view of the device shown in FIG. 3.
FIG. 5 is a pictorial view of an embodiment of the invention, showing a user's hand and disclosing the particular method for removing a part of a cap and exposing the stopper for use.
FIG. 6 is a side elevational view of the device shown in FIG. 5, after the overcap has been removed.
FIG. 7 is a top view of the device shown in FIG. 6.

Extending up from the shoulder 13 is a cylinder 17 having a top rim 19. The top of cylinder 17 is preferably formed into a concave surface 21, thereby forming top ridge 19 and providing both strength in the cylinder and also a gripping edge. As shown in FIG. 5, the pressure of the thumb on the ridge 19 removes cylinder 17 and exposes stopper 23, including the upper portion 25 of the stopper shown in this embodiment. In embodiments such as shown in FIGS. 1 and 2, of course, stopper 23 terminates at the face of shoulder 13. In either case, the upper surface of stopper 23 underneath shoulder 13 is in direct and intimate contact with the stopper 23. Any of the myriad of stopper shapes may be used with the present invention.

Figure 8:
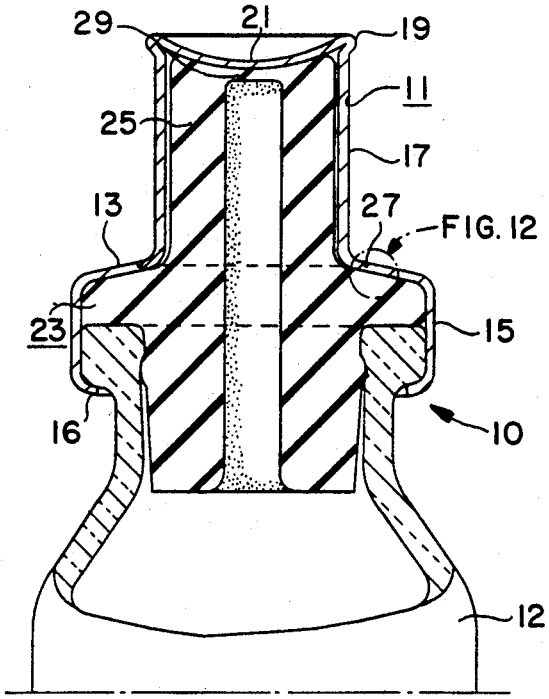
FIG. 8 is a sectional view taken along the lines 8—8 of the device shown in FIG. 3.
Figure 9:
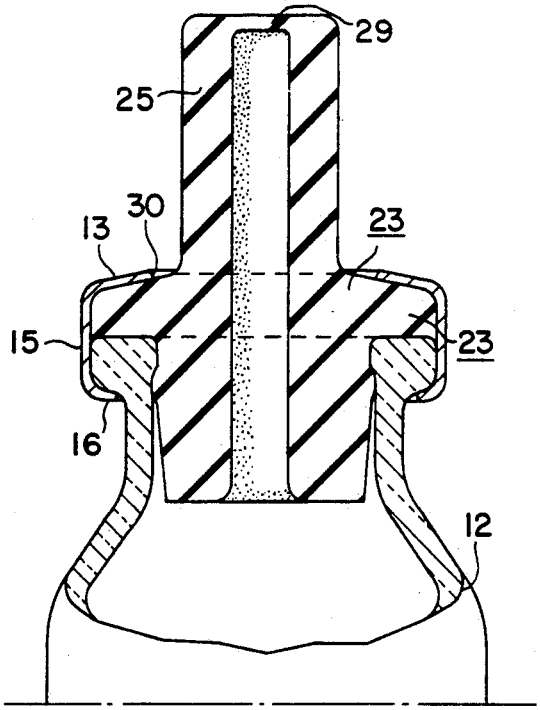
FIG. 9 is a sectional side elevational view taken along the lines 9—9 of FIG. 6.

In FIGS. 8 and 9, the mechanism for separation of the cylinder 17 from the shoulder 13 can be seen. Whether or not an upper portion 25 of stopper 23 is present, pressure on rim 19 will cause scoring ring 27 to break, thereby allowing the cylinder 17 to be removed. Once removed, the upper portion 25 of stopper 23 is accessible, and the needle can penetrate the thin region 29 of upper part 25 of stopper 23, permitting access to the contents of the bottle.

Figure 12:
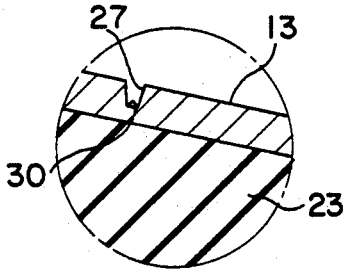
FIG. 12 is an enlarged view of the portion shown in the circle in FIG. 8 and identified FIG. 12.

Shown in FIG. 12 is a detailed view of the relationship between the groove 27, the shoulder 13, and the stopper 23, with the shoulder and stopper being in intimate contact with each other and the groove 27 decreases to a declining and tapered edge 30 which is in continuous contact against the stopper 23.

Figure 10:
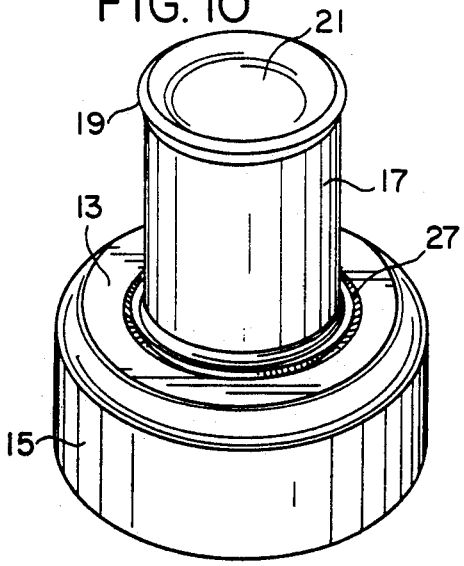
FIGS. 10 and 11 are perspective views showing two additional embodiments of the present invention.
Figure 11:
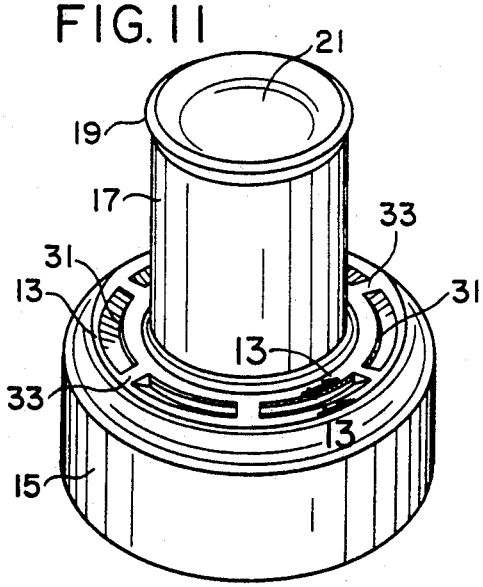
Figure 13:
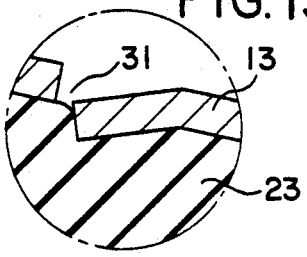
FIG. 13 is a sectional view taken along the lines 13—13 of the device shown in FIG. 11.

In FIG. 10, the groove 27 is what is known as partial scoring, also shown in FIG. 12. An alternative embodiment is shown in FIG. 11. In FIG. 11, the grooves 31 are in fact actual gaps between the shoulder 13 and the cylinder 17. Cylinder 17 is held onto shoulder 13 by a plurality of bridges 33, which are also frangible and function in the same way as the controlled scoring 27. FIG. 13 shows the way that the bridges 33 interact with the rubber stopper 23.

As is readily appreciated from the foregoing description of the preferred embodiments of the present invention, a sturdy and easy to use one piece cap assembly has been provided which is easy to manufacture and which can be handled by rapid assembly machines. In contrast, the two component systems where a removable cap is placed on a cap assembly is much more difficult and expensive to manufacture. At the same time, the cap assembly of the present invention is easy to use and can conveniently be utilized by the health care personnel in one hand, thereby freeing the other hand for other activities such as applying antiseptics with a cotton swab or the like.

While particular embodiments of the present invention have been illustrated and described herein, it is not intended to limit the invention and changes and modifications may be made therein within the scope of the following claims.

What is claimed is:

1. A container cap formed from one piece, comprising:

a cap body having an annular shoulder with an inner and outer terminal edge, said shoulder having skirt means depending from the outer terminal edge of said shoulder;

upper cylinder means attached to said annular shoulder at its inner terminal edge and extending upward for sufficient distance to define an annular flared exposed lip for thumb contact, said cylinder including a concave tip forming said lip; and said upper cylinder means being attached to said annular shoulder by an annular scoring ring in said shoulder and spaced radially outwardly from said upper cylinder means, thereby having a larger radius than said cylinder means.

2. The cap of claim 1 wherein said annular scoring ring is V-shaped.

3. The cap of claim 1 wherein said annular scoring ring consists of scoring on both sides of said shoulder.

* * * * *